US006601722B1

(12) United States Patent
Litoux-Desrue et al.

(10) Patent No.: US 6,601,722 B1
(45) Date of Patent: Aug. 5, 2003

(54) COMPOSITE STOPPER WITH CONTROLLED PERMEABILITY

(75) Inventors: François Litoux-Desrue, Tours (FR); Philippe Poitevin, Dissay-sous-Courcillon (FR)

(73) Assignee: Cortex SAS, Dizy (FR)

( * ) Notice: Subject to any disclaimer, the term of this patent is extended or adjusted under 35 U.S.C. 154(b) by 0 days.

(21) Appl. No.: 09/857,444

(22) PCT Filed: Dec. 3, 1999

(86) PCT No.: PCT/FR99/03014

§ 371 (c)(1),
(2), (4) Date: Jun. 4, 2001

(87) PCT Pub. No.: WO00/34140

PCT Pub. Date: Jun. 15, 2000

(30) Foreign Application Priority Data

Dec. 4, 1998 (FR) ..... 98 15351

(51) Int. Cl.[7] ..... B65D 39/00
(52) U.S. Cl. ..... 215/364
(58) Field of Search ..... 215/364, 270, 215/261

(56) References Cited

U.S. PATENT DOCUMENTS 288,521 A * 11/1883 Walker ..... 215/364
368,228 A * 8/1887 Morehouse ..... 215/364
443,971 A * 12/1890 McHugh ..... 215/364
3,715,047 A * 2/1973 Sado ..... 215/261
5,279,606 A * 1/1994 Haber et al. ..... 215/364
5,904,965 A * 5/1999 Noel et al. ..... 215/355
6,153,275 A * 11/2000 Yaniger ..... 215/355

FOREIGN PATENT DOCUMENTS

| | | | | |
|---|---|---|---|---|
| EP | 0 532 367 A2 | | 3/1993 | |
| FR | 681.688 | | 5/1930 | |
| FR | 983.488 | | 6/1951 | |
| FR | 1068263 | * | 6/1954 | ..... 215/364 |
| FR | 1100335 | * | 9/1955 | ..... 215/364 |
| FR | 1338657 | * | 8/1963 | ..... 215/364 |
| FR | 1573650 | * | 7/1969 | ..... 215/364 |
| FR | 2 644 142 | | 9/1990 | |

* cited by examiner

*Primary Examiner*—Jes F. Pascua
(74) *Attorney, Agent, or Firm*—Young & Thompson

(57) ABSTRACT

A composite stopper for closing bottles, in particular wine bottles, comprising a body made of a compressible material such as cork, provided at least at its end facing the contents of the bottle to be closed with matching element forming a joint. The element (25) is made from a substantially incompressible elastomer, filling up a cavity arranged circular in shape and a concentric position in the end surface (24) of the stopper body (22) and having a volume such that the element, under the effect of compression whereto the stopper body is subjected when the bottle is closed, is elastically deformed at the front of the end surface, so as to produce after closure, at the front of the cork body end surface, a sealing joint covering the whole of the end surface and in contact the bottle neck inner surface (26). The invention is useful for closing bottles of sparking or non-sparking wine.

12 Claims, 2 Drawing Sheets

COMPOSITE STOPPER WITH CONTROLLED PERMEABILITY

FIELD OF THE INVENTION

The present invention relates to a controlled permeability composite stopper for stopping bottles, in particular bottles of wine, having a body made from a compressible material such as cork, fitted with complementary means forming a seal at least at the end facing toward the content of the bottle.

BACKGROUND OF THE INVENTION

Stoppers of the above type are described in French patents Nos. 983 488, 1 068 263, 1 100 335, 1 338 657, 1 573 650, 2 644 142 and 2 736 036 and European patent application EP-A-0 532 367, for example. In the above documents, the complementary seal means can be sheets, films, coatings, disks, etc. of synthetic material, rubber, elastomer, for example silicone elastomer, covering at least the whole of the end face of the stopper facing toward the content of the bottle to be stopped.

The use of cork in stopping wines is related to the exceptional qualities of the material, namely its virtual freedom from rotting, compressibility, resilience, sealing effect, easy machining from raw cork-oak bark, aptitude for gaseous exchange, durability, etc.

However, cork is also the cause of certain organoleptic problems due to interaction with the wine. Also, given the fact that it is machined, the tolerances that apply and defects that are sometimes difficult to detect, despite rigorous inspection, a cork stopper is sometimes incapable of providing a total liquid seal at the cork-glass interface, whence the well-known "leaky bottle" phenomenon.

The proposals in the patents cited above are not satisfactory, in particular because the complementary means provided on at least one end face of the stopper cause problems when the stopper is pushed into the bottle neck. Because the means referred to cover the whole of the end face of the stopper facing toward the content of the bottle, it is the material from which the complementary means are made that comes into contact with the end of the neck when the stopper is pushed in after compressing it radially. Because the material from which the complementary means are made is incompressible, unlike the cork constituting the body of the stopper, the complementary means are not subjected to the same deformation as the body of the stopper, with the attendant risk of imperfections such as creasing, cracking, peeling, etc. In this regard, it should be noted that stopping a bottle includes an operation of radially compressing the stopper, which has a diameter of 24 mm for still wine or 31 mm for sparkling wine, to a diameter of 15.5 mm, in jaws, the compressed stopper then being pushed into the bottle neck, where it expands to the inside diameter of the neck, which is 19 mm for a still wine or 17 mm for a sparkling wine.

Pressing in stoppers compressed in this way is not a problem if the stoppers are made entirely of cork.

It is a problem, however, if the end face of the stopper facing toward the content of the bottle to be stopped is covered with complementary means in the form of a synthetic material sheet, film, disk or coating.

It is then the complementary means that first come into contact with the end of the neck and are stressed to the point of being damaged. Also, the material from which the complementary means are made has a high coefficient of friction relative to the glass of the bottle neck, unlike the cork of conventional stoppers, which are incidentally often treated to slide more easily.

For all the above reasons, the composite stoppers disclosed in the documents previously cited have in practice not become the norm for stopping wine.

SUMMARY OF THE INVENTION

The present invention is directed to a composite stopper which remedies the disadvantages of the usual stoppers made entirely of cork and also the disadvantages of the composite stoppers disclosed in the prior art patents cited above.

A composite stopper in accordance with the invention for stopping the neck of bottles, in particular bottles of wine, comprises a body made from a compressible material such as cork, fitted with complementary means forming a seal at least at its end facing toward the content of the bottle to be stopped, characterized in that said means comprise a member made from a substantially incompressible elastomer, virtually completely filling a circular section cavity formed concentrically in an end face of the stopper body so that a ring of the end face of the stopper body remains around said cavity, which has a volume such that said member, due to compression of the stopper body during stopping, is elastically deformed forward of said end face, after stopping, so as to establish after stopping, forward of said end face of the stopper body, a seal covering the whole of said end face and in contact with the inside face of the bottle neck.

In accordance with the present invention, before the stopper is compressed, the substantially incompressible elastomer member filling the cavity in the end face does not cover the whole of the end face of the stopper, but leaves a ring of cork between its outside edge and the outside edge of the end face.

The ring of cork enables the bottling operation to be carried out in the usual way, without modification. Because the relaxation time of the elastomers used is greater than one second and, in the usual bottling machines, the time between compressing the stoppers and pushing them is generally less than one second, the elastomer does not have time to deform completely, in response to the compression of the body of the stopper, before the stopper is pushed into the bottle neck. When the stopper is pressed in, it is therefore the outside edge of the ring of cork which comes into contact with the top of the neck of the bottle, and the conditions under which the stopper slides in the neck are therefore the same as with stoppers made entirely of cork.

In other words, the stopping operation is in no way modified by the presence of the elastomer member on the stopper according to the invention.

The volume (diameter and depth) of the cavity filled with elastomer can vary, in particular as a function of the degree of compression of the stopper body, which varies according to the type of wine to be stopped. However, the cavity is preferably at least 1 mm deep at its deepest point, before compression.

The elastomer member is shaped to leave a ring with a (radial) width of at least 1 mm on the end face of the stopper body before compression of the stopper body.

Said cavity can have a substantially cylindrical shape, for example, but it preferably has a divergent shape, i.e. a diameter that increases from the bottom toward the open side.

The elastomer constituting the member filling said cavity is preferably a foodstuffs grade silicone elastomer.

The elastomer member is preferably molded and cross-linked before it is fitted into the cavity, but can also be obtained by molding and cross-linking the raw elastomer in the cavity of the stopper body.

In one embodiment the elastomer can be an elastomer permeable to small gas molecules such as $H_2$, $N_2$, $O_2$, $CO_2$ and impermeable to large molecules such as molecules with aromatic cycles, including those responsible for the "corked taste". The seal consisting of the elastomer member therefore does not degrade in any way the exchange of small-molecule gases, leaving the cork of the stopper body to fulfill its usual role of controlling gas exchange on its own.

BRIEF DESCRIPTION OF THE DRAWINGS

Illustrative and non-limiting embodiments of a composite stopper in accordance with the invention are described in more detail hereinafter; in the drawings.

DETAILED DESCRIPTION OF THE INVENTION

Figure 1:
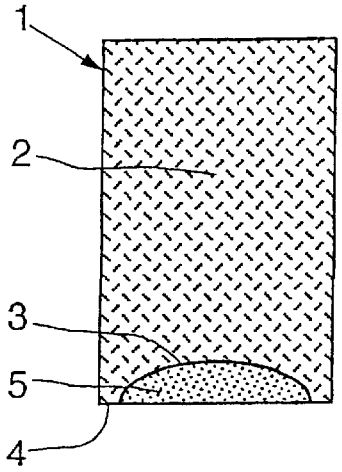
FIGS. 1 and 2 show a stopper in accordance with the invention for sparkling wine, before radial compression of the stopper and after pushing the stopper into the bottle neck.

Referring to FIG. 1, a stopper 1 intended for stopping a bottle containing sparkling wine, for example champagne, has a stopper body 2 of natural or reconstituted cork, or a mixture of the two, in the shape of a cylinder or a rectangular parallelepiped with rounded edges, and has two plane and parallel end faces. There is a cup-shaped or dome-shaped concentric circular cavity 3 in one end face, the edge of the cavity 3 being spaced from the edge of the corresponding end face so that a ring 4 of the plane end face of the stopper body remains around the cavity 3. The cavity 3 is filled with a substantially incompressible elastomer 5, for example a silicone elastomer, which is flush with the end face in the example shown.

Figure 2:
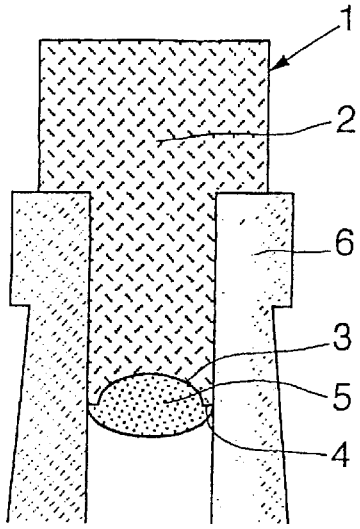

FIG. 2 shows the stopper 1 from FIG. 1 after it has been pushed into a bottle neck 6. To this end, the cork stopper 1 is radially compressed in the usual way over the portion of its length intended to be pushed into the bottle neck 6, which reduces its diameter from 31 mm to 15.5 mm. This radial compression is followed in less than one second by pushing the compressed part of the stopper 1 into the bottle neck 6. Because of the radial compression of the stopper body 2, the incompressible elastomer member 5 is subjected, after a relaxation time of approximately one second, and therefore after the stopper 1 has been pushed into the bottle neck 6 and expanded to the inside diameter (17 mm) of the neck, to elastic deformation forward of the end face in which the elastomer member 5 is disposed, so that the member 5 assumes the shape inside the bottle neck 6 shown in FIG. 2, projecting radially outwards onto the ring 4 until it touches the inside face of the neck 6, so establishing a seal over the whole of the end face of the stopper 1.

Because of the relaxation time of the elastomer of the member 5, pushing the stopper 1 into the bottle neck 6 is not modified compared to pushing in a stopper made entirely of cork because, during pushing in, only the cork of the stopper 1 comes into contact with the glass of the neck 6.

Figure 3:
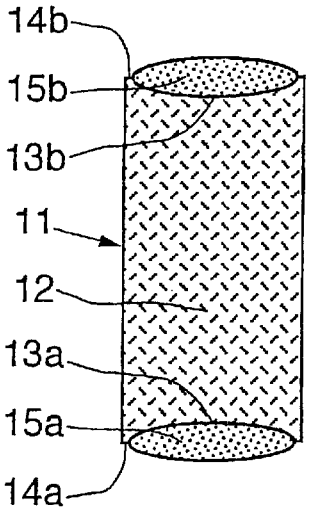
FIGS. 3 and 4 are corresponding views of a stopper for still wine.

FIG. 3 shows a stopper 11 for still wine, having a cork stopper body 12 which has dome-shaped or cup-shaped cavities 13*a*, 13*b* in respective end faces. Each cavity 13*a*, 13*b* is circular and is formed concentrically in the corresponding end face so as to leave around it a ring 14*a*, 14*b* of cork in the plane of the end face. Each cavity 13*a*, 13*b* is filled with a substantially incompressible elastomer constituting, in the example shown, a member 15*a*, 15*b* with a convex outside face.

Figure 4:
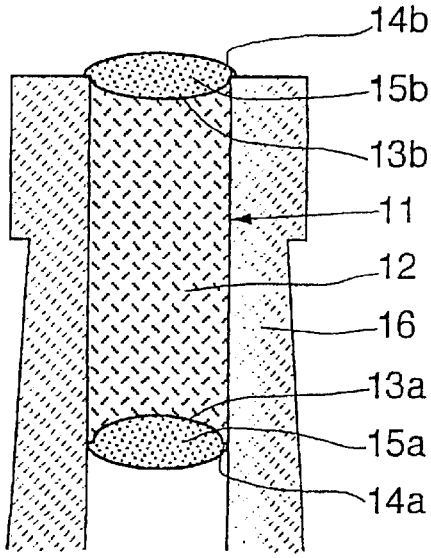

In FIG. 4, the stopper 11 from FIG. 3 has been pushed into a bottle neck 16 after radial compression of the stopper 11 has reduced its diameter from 24 mm to 15.5 mm. After a relaxation time of approximately one second, the radial compression to which the cork of the stopper body 12 is subjected by elastic compression causes axial deformation of the incompressible members 15*a*, 15*b*, as a result of which the members 15*a*, 15*b* adopt the shape shown in FIG. 4. Each member 15*a*, 15*b* expands radially, forward of the corresponding end face of the stopper body 12, which has expanded to the inside diameter (17 mm) of the neck, until it comes into contact with the glass of the neck 16 of the bottle, where it constitutes a seal for the liquid contained in the bottle.

The second seal created by the member 15*b* at the free end of the neck 16 protects the cork of the stopper body 12 from mildew, worms and other forms of external aggression.

A circular cavity, regardless of its shape, can be machined directly into the end face of the stopper body. To make a cylindrical cavity, for example in the case of a stopper body consisting of a plurality of disks, it is possible to remove the center of the last disk (so that it is converted into a short tube) and stick it to the remaining part of the stopper body.

The elastomer member can be made by molding and cross-linking "raw" elastomer directly in the cavity, for example, but it can equally well be molded and cross-linked separately and then mounted and fixed in the cavity, for example stuck or clipped in the cavity.

To enable the elastomer member to fulfill its functions, the open side of the cavity can occupy almost all of the end face of the stopper body, but here, before the stopper is compressed radially, the member leaves a ring 4 whose (radial) width is at least 1 mm.

The width of the ring 4 can be in the range from approximately 1 mm to approximately 2 mm in the case of a 24 mm diameter stopper for still wine, for example, or in the range from approximately 3 mm to approximately 7 mm for a 31 mm diameter stopper for sparkling wine.

Figure 5:
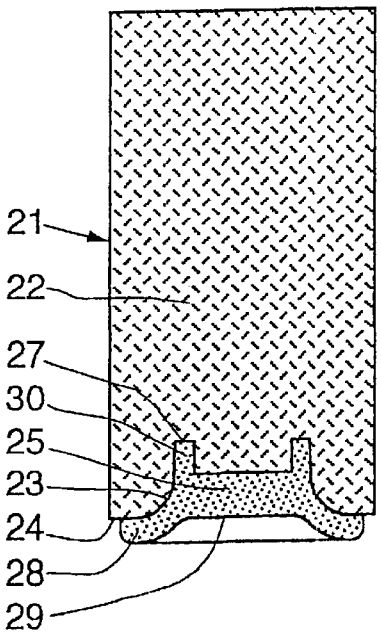
FIGS. 5 and 6 are corresponding views of a preferred embodiment of a stopper according to the invention.
Figure 6:
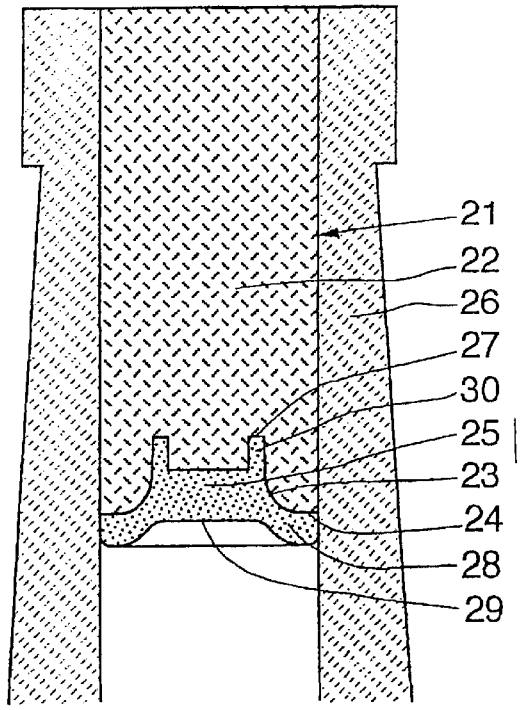

In the preferred embodiment shown in FIGS. 5 and 6, which here applies to stopping a bottle neck 26 for still wine, but which can be used practically without modification for stopping bottles of sparkling wine, the cavity 23 formed concentrically in one end face of the body 22 of a stopper 21, leaving an outside ring 24 of said end face, has a diameter that increases from the bottom of the cavity toward its open side, so that the cavity has a "trumpet-shaped" profile. In other words, the flanks of the cavity are convex rather than concave, as in the previous examples.

Furthermore, note that the cavity 23 has an annular groove 27 in its bottom which increases its depth. The preformed molded elastomer member 25 has an outside part 28 in the form of an annular bead which protects after the member 25 is placed in the cavity 23, at least partly over the end face of the stopper body 21, the central part 29 of the outside face of the elastomer member 25, set back relative to the bead 28, being substantially level with the end face (ring 24) of the stopper body (before the latter is compressed).

Note also that the member 25 is here fixed to the stopper body 22 only at the location of the annular rib 30 projecting from its bottom, which nests in the groove 27 of the cavity 23.

This encourages elastic deformation of the member 25 forward of the end face of the stopper body, after stopping the neck 26 after radially compressing the stopper body 22, the member 25 being able to slide easily on the flanks of the cavity 23, so that after stopping the bead 28 as a whole is pressed perfectly against the inside face of the neck 26, forward of the ring 24, as shown in FIG. 6.

Finally, the part of the member 25 nested in the cavity 23, and therefore subjected to elastic deformation in response to radial compression of the stopper body 22, here has a smaller diameter than in the previous examples, corresponding to approximately 50%, or even less, of the diameter of the stopper body before compression, depending on the degree to which the stopper is compressed. On the other hand, the (axial) thickness of the nested part of the member 25 is greater, and can be equal to at least 3 mm, for example, for a 24 mm diameter still wine stopper or for a 31 mm diameter sparkling wine stopper.

Note that the elastomer used in the invention, defined as being "substantially incompressible", is an elastomer which deforms elastically without significantly decreasing its volume when it is compressed.

In the context of the invention, the volume of the elastomer is advantageously reduced by less than 15%, and preferably less than 10%.

The elastomers that can be used in the context of the invention include in particular hot-vulcanized silicone elastomers (EVC), for example foodstuffs grade polydimethyl/vinylmethylsiloxane (VMQ), which can be shaped by molding and has a Shore A hardness in the range from approximately 35 to approximately 70. Conclusive tests have been carried out with S 60 i 59×platinum-catalyzed EVC from VERNERET, LA MOTHE-AUX-AULNAIES, F-89120 CHARNY, FRANCE, for example, which has a Shore A hardness of 60.

Conclusive tests have also been carried out with S 60 i 01 L liquid silicone elastomer from the same company, which has a Shore A hardness of 60.

The above silicone elastomers, which are permeable to small gas molecules, can be replaced with B 50 i 20 B foodstuffs grade chlorinated butyl rubber from the same company, or a corresponding butyl rubber containing bromine, for example, which has a Shore A hardness of 50. The above rubbers have the particular feature of being totally impermeable, even to small gas molecules. Stoppers equipped with seal members made from the above rubbers can be used in particular for wines to be consumed young, i.e. wines that do not improve through aging.

What is claimed is:

1. A composite stopper for stopping the neck of bottles of wine, comprising: a stopper body of generally cylindrical shape made from an elastically compressible material and having at least one circular flat end face, said stopper body having a circular cavity with a bottom formed concentrically in said end face, the diameter of the outer edge of said cavity being smaller than the diameter of the outer edge of said end face in the uncompressed condition of the stopper body such that a ring of said end face remains between the outer edge of said cavity and the outer edge of said end face; and a circular member made from an elastomer which is liquid impervious and which is elastically deformable but substantially incompressible, said circular member being fitted into said cavity such as to completely fill said cavity and to leave uncovered at least an outer portion of said ring of said end face of the stopper body, said cavity having such a volume that said member, upon radial compression to which the stopper body is subjected upon stopping, is elastically deformed forward of said end face, so as completely to cover said end face after stopping.

2. A stopper according to claim 1, wherein said cavity is at least 1 mm deep at its deepest point.

3. A stopper according to claim 1, wherein said circular member is shaped to leave uncovered a ring with a radial width of at least 1 mm on the end face of the stopper body before compression of the stopper body.

4. A stopper according to claim 1, wherein said elastomer is a silicone elastomer.

5. A stopper according to claim 1, wherein said elastomer is an elastomer permeable to small gas molecules including $H_2$, $N_2$, $O_2$, and $CO_2$ and impermeable to large molecules including molecules with aromatic cycles.

6. A stopper according to claim 1, wherein said circular member is molded and cross-linked before it is mounted and fixed in said cavity.

7. A stopper according to claim 1, wherein said circular member has a part in the form of an annular bead projecting forward of said end face of the stopper body before the stopper body is compressed.

8. A stopper according to claim 1, wherein said cavity has a divergent shape with convex flanks.

9. A stopper according to claim 1, wherein said circular member is fixed to the stopper body only at the bottom of the cavity.

10. A stopper according to claim 9, wherein said circular member has an annular rib on its bottom and the cavity has an annular groove in its bottom in which said rib is nested and fixed.

11. A stopper according to claim 1, wherein said stopper body is made from cork.

12. A stopper according to claim 1, wherein said cavity has a width greater than its depth.

* * * * *